US005238304A

United States Patent [19]

Zimmermann

[11] Patent Number: 5,238,304

[45] Date of Patent: Aug. 24, 1993

[54] PROCESS AND DEVICE FOR MIXING

[76] Inventor: Wolfgang Zimmermann, Tulpenstr. 15, D-8201 Schechen, Fed. Rep. of Germany

[21] Appl. No.: 549,018

[22] PCT Filed: Mar. 7, 1989

[86] PCT No.: PCT/EP89/00232

§ 371 Date: May 13, 1991

§ 102(e) Date: May 13, 1991

[87] PCT Pub. No.: WO89/08495

PCT Pub. Date: Sep. 21, 1989

[30] Foreign Application Priority Data

Mar. 9, 1988 [DE] Fed. Rep. of Germany ..... 3807658

[51] Int. Cl.[5] ..... B01F 11/00

[52] U.S. Cl. ..... 366/219; 366/108; 366/216

[58] Field of Search ..... 68/171, 172; 366/108, 366/110, 111, 116, 117, 219, 237, 239, 210, 211, 215, 216, 220, 232

[56] References Cited

U.S. PATENT DOCUMENTS

| | | | |
|---|---|---|---|
| 2,297,154 | 9/1942 | Kantor | 24/54 |
| 2,610,041 | 9/1952 | Stahl | 259/72 |
| 3,018,092 | 1/1962 | Johnson | 259/54 |
| 3,046,157 | 7/1962 | Nyman | 366/219 |
| 3,706,443 | 12/1972 | Oberhauser | 259/72 |
| 4,004,783 | 1/1977 | Wilson | 366/110 |
| 4,004,784 | 1/1977 | Distler | 259/72 |
| 4,061,019 | 12/1977 | Blasetti | 73/662 |
| 4,146,335 | 3/1979 | Hutchings | 366/239 |
| 4,415,270 | 11/1983 | Heinis | 366/216 |
| 4,775,242 | 10/1988 | Bohle | 366/216 |

FOREIGN PATENT DOCUMENTS

| | | | |
|---|---|---|---|
| 976266 | 3/1951 | France . | |
| 2028709 | 10/1970 | France . | |
| 456628 | 11/1972 | U.S.S.R. | 366/219 |
| 895485 | 8/1974 | U.S.S.R. | 366/219 |
| 803959 | 9/1978 | U.S.S.R. | 366/111 |
| 651833 | 12/2976 | U.S.S.R. | 366/219 |
| 1249102 | 10/1971 | United Kingdom . | |
| 2045101 | 10/1980 | United Kingdom . | |

*Primary Examiner*—Philip R. Coe
*Assistant Examiner*—Terrence R. Till
*Attorney, Agent, or Firm*—Nixon & Vanderhye

[57] ABSTRACT

A mixing container is mounted for rotation about two or more distinct axes of rotation. A random generator is applied to drive the container for rotation about one or more of the axes at a speed and/or in a direction of rotation such that the container tumbles with a constantly irregular mixing movement and with a constantly changing Froude number.

15 Claims, 2 Drawing Sheets

PROCESS AND DEVICE FOR MIXING

Figure 1:
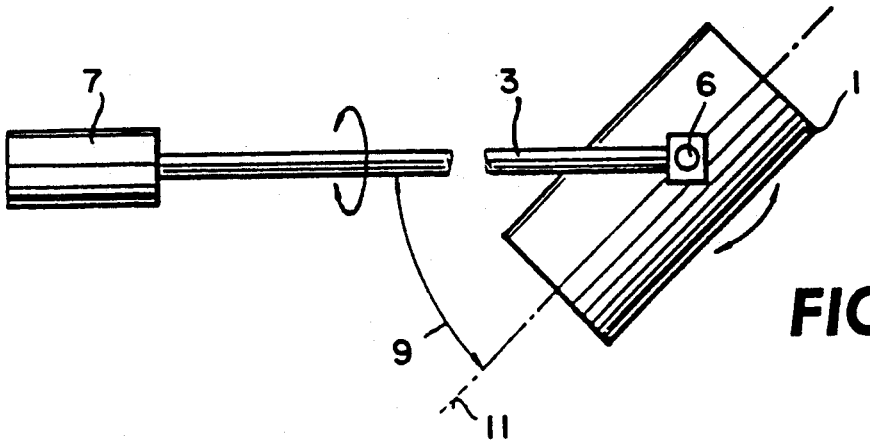

The invention relates to a mixing process according to the introductory clause of claim 1 and a mixing device for this purpose according to the introductory clause of claim 6.

Conventional mixers of solids are used in many engineering fields. Great importance is attached to such mixers of solids especially also in the field of working up or processing plastics and especially also in the field of pharmaceuticals as well as in the ceramics and paint industry. What is to be attempted with these mixers is to mix, as uniformly as possible, differing particles that differ, for example with respect to their size, shape and density, which means that the deviations in the density and composition in all the materials being mixed become minimal.

But this means recurring very great difficulties since separations can occur again and again, at least in partial areas, in a way not previously solved.

Because of this, the object of this invention is to provide a mixing process and an associated mixing device with which a very much faster and more uniform, thorough mixing can be obtained without dead zones and with comparatively simple means compared to the prior art.

The object is achieved with respect to the process according to the features indicated in claim 1 and, with respect to the device, according to the features indicated in claim 6.

A considerable technical advance is achieved by the invention in a surprising way. Precise studies have shown that, with conventional mixers of solids, the uniformly or regularly recurring mixing movement cannot produce an ideal, uniform mixture of the particle properties that are also partially very different, that are to be thoroughly mixed and that can differ from one another for example with respect to their size, shape or density, but that rather there is always a tendency toward separation. Such a regular mixing movement can produce, for example, a separation in a solids stream due to gravitational force; with high Froude numbers that can signify a centrifugal movement of the materials being mixed, an air separation, etc., can additionally occur.

Froude numbers involve, as is known, the ratio of the centrifugal force to the gravitational force of the materials being mixed.

The process according to the invention and the associated mixing device according to the invention are distinguished especially in that no uniform and recurrent movement sequences are used. Rather, attention is paid that, during mixing, the angle of the mixing container relative to the mixer axis changes irregularly during the rotation of the mixing container around its axis of rotation or mixer axis, i.e., is constantly set differently, so that a stochastic, random distribution is produced in this respect. In a further development, the speed, i.e., the speed of rotation and also the direction of rotation are constantly adjusted irregularly and nonuniformly so that stochastic, randomly distributed control is produced also in this respect. Thus the control in this respect comprises a random-check generator.

In addition to the constant stochastic, i.e., nonuniform change in the angle of inclination between the mixing container and its mixer axis, the speed and direction of rotation of the axis of rotation or of the mixer axis of the mixing container can also simultaneously be stochastically controlled and changed in a preferred embodiment. This double randomness causes the Froude number to change constantly and irregularly. Separations are prevented to a large extent so that a mixing quality is achieved that previously could not be achieved because of separation.

In the industrial embodiment of the mixing device according to the invention, suitably the material hoppers of the processing machines are used directly as mixing vessels so that separations that occur during decanting of the materials being mixed are eliminated. After mixing, the material hopper must be set, vibrationless, on the processing machine.

Grinding media can also be put into the mixing vessel of the stochastically operating mixing device. This produces a stochastically controlled mill. Although varying shapes are possible, spherical or cylindrical grinding media are especially suited. Because of the varying Froude numbers, the solid is pulverized by friction and by impact. With smaller Froude numbers, the blowing away of the fines before the impact of the grinding medium to be observed in vibrating ball mills is avoided, for example. On the other hand, with higher Froude numbers, coarse-particle material to be ground is shattered by impact. In size reduction, the stochastic control thus comprises a wide particle size range.

The stochastically controlled tumbling movement of the mixing container can be used also for washing machines. In other words, the device can be used at least also in those cases in which, as in the case of the textile items placed in the washing drum, treatment of them is to proceed with constantly changing Froude numbers. In the case of the washing drum, the mixing vessel is thus fed through the lye container with correspondingly stochastic control.

Between the textiles and the lye, relative accelerations constantly are produced that thus intensively and rapidly clean the dirt from the cloth.

It is true that an "unstable mixer" has already become known that is built like a stirrer. This stirring device works with an agitator mounted to pivot and to which blades are attached in the usual way. During rotation, the blade angle of these blades is to be adjustable, and the size of the blade angle is subjected to a random control. But this randomly controlled, stochastic change in the blade angle of the blades on the rotor, similar to a ship's propeller with rotor blades whose blade angle can be changed, is used essentially only to stir liquids. But also when stirring pulverized substances, the entire stirring and mixing operation is comparable to that of liquids, since there is a fluidized stream behavior also when stirring substances comprising powders or solid materials. In particular, with such a device, varying Froude numbers cannot purposely be generated or achieved, especially since the height of the material to be mixed placed in the stirring vessel remains practically unchanged and thus also the gravitational forces remain uniform. Such a stirring device thus operates completely differently and is designed completely different from this invention.

Figure 2:
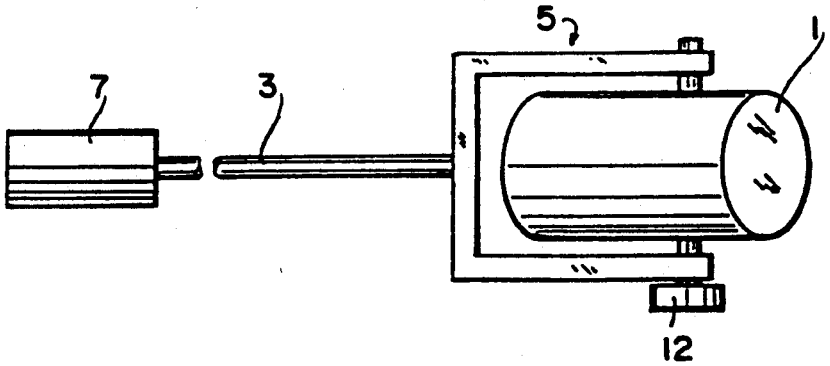
Figure 3:
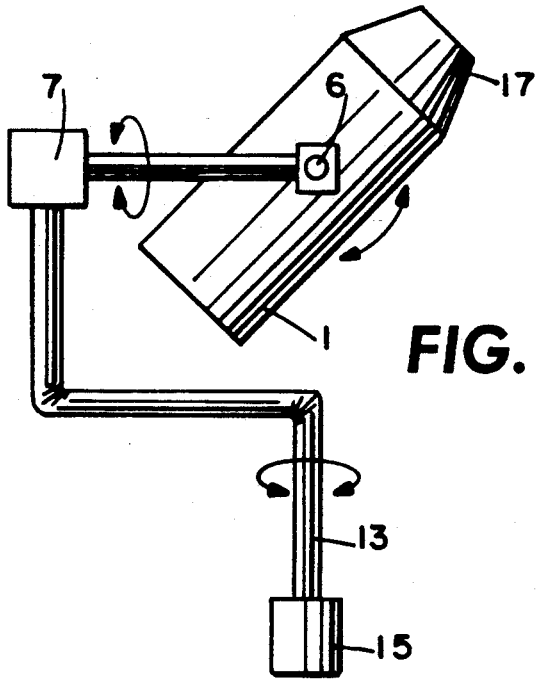

Other advantages, details and features of the invention follow below from the embodiment represented based on drawings. Here there are shown specifically in:

FIG. 1, a diagrammatic side view of the mixing device;

FIG. 2, a diagrammatic top view of the embodiment according to FIG. 2;

FIG. 3, a diagrammatic representation of a modification to FIG. 1.

FIGS. 1 and 2 show a cylindrical mixing vessel, for example, that is held by a part of fork bearing 5 that forms the mixer axis or axis of rotation 3 (but a one-sided suspension for easier mounting and detaching of the mixing container is also possible). Mixer shaft/axis of rotation 3 is driven by a drive 7 with stochastically differently distributed rotating speed or speed, and the direction of rotation can also be reversed additionally in a stochastically distributed way. In operation, not only are the speed and the direction of rotation of mixer shaft/axis of rotation 3 changed stochastically, i.e., randomly distributed within broad operating ranges, but especially also angle of inclination 9, for example between a longitudinal axis 11 of mixing container 1 and its mixer shaft/axis of rotation 3. Here in FIG. 1, the container axis that supports mixing container 1 directly is provided with reference 6, and in the embodiment shown, as indicated in FIG. 2, container axis 6 is perpendicular to mixer shaft/axis of rotation 3 and both lie in a common plane, so that the axis lines formed by mixer shaft/axis of rotation 3 and container axis 6 intersect in the interior of mixing container 1.

Another drive 12 is provided in the area of fork bearing 5 for the stochastically changed adjustment of angle of inclination 9. The electric control and power supply lines not represented in more detail in the drawings are placed inside the shafts and require slip ring-like contacts at the suitable points, for example between mixer shaft/axis of rotation 3 and corresponding stationary drive 7 of this axis.

As indicated in FIG. 3, to achieve further rotational movement in the direction of a third degree of freedom, mixer shaft/axis of rotation 3 could also be mounted to pivot around another primary axis 13 that is at an angle to mixer shaft/axis of rotation 3, at an oblique angle, in particular at a right angle, and the arrangement can also be similar to a cage so that also the extension of this third axis of rotation intersects the extended straight lines of the axes of mixer shaft/axis of rotation 3 and container axis 6 at a common point of intersection that preferably lies in the central point or center of gravity of mixing container 1. This primary axis 13 can also be driven stochastically, i.e., with randomly distributed speed and direction of rotation, and specifically by another drive 15.

Mixing container 1 should not be either spherically symmetrical or cubical.

Based on FIG. 3 it is also shown that, for example, at least one boundary side of the mixing container can be made in the form of a hopper 17 that can be closed.

When the material being mixed is decanted, this hopper 17 can be used so that separations that could occur during decanting of the material being mixed when a separate hopper is used are eliminated. In industrial embodiments of the mixer device explained above, the material hopper of the processing machines is used suitably directly as mixing vessel. After mixing, the material hopper must be placed vibrationless on the processing machine.

The embodiment shown in FIGS. 1 to 3 can basically be used also in washing machines, and mixing container 1 then forms the washing drum that is conveyed through the lye container.

Based on the embodiments shown, many modifications can be made that relate especially to the angle position of the various axes of rotation to one another or to the orientation of the mixing container to its container axis, which can optionally be selected to be an oblique angle.

I claim:

1. A process for mixing solids employing a mixing container for receiving materials to be mixed and rotatable with at least two degrees of freedom about a first mixer axis and a second container axis comprising the steps of:

rotating the mixing container about both said first and second axes; and rotating the mixing container about one of said axes at a speed which changes stochastically, such that the mixing container tumbles with a constantly irregular mixing movement and with a constantly changing Froude number.

2. A process according to claim 1, including rotating the mixing container about another of said axes at a speed which changes stochastically.

3. A process according to claim 2, wherein said axes are perpendicular to one another.

4. A process according to claim 1, including rotating the mixing container about one of said axes with the direction of rotation of the mixing container changing stochastically.

5. A process according to claim 1, including rotating the mixing container about a third axis angularly related and nonparallel to said first and second axes.

6. A process according to claim 5, including rotating the mixing container about said third axis at a speed which changes stochastically.

7. A process according to claim 1, including adding grinding media to the material to be mixed in the mixing container.

8. A process for mixing solids employing a mixing container for receiving materials to be mixed and rotatable with at least two degrees of freedom about a first mixer axis and a second container axis, comprising the steps of:

rotating the mixing container about both said first and second axes; and rotating the mixing container about one of said axes with the direction of rotation of the mixing container changing stochastically, such that the mixing container tumbles with a constantly irregular mixing movement and with a constantly changing Froude number.

9. A process according to claim 8, including rotating the mixing container about another of said axes with the direction of rotation of the mixing container about said another of said axes changing stochastically.

10. A process according to claim 8, including rotating the mixing container about a third axis angularly related and nonparallel to said first and second axes.

11. A mixing device for mixing materials in a container to achieve a random distribution of materials throughout the mixing container comprising:

a mixing container having first and second axes of rotation;

means mounting said mixing container for rotation about said first axis;

first means for rotating said mixing container about said first axis;

means mounting said mixing container for rotation about said second axis;

second means for rotating said mixing container about said second axis; and wherein one of said first and second rotating means, includes means for rotating the mixing container about one of said first and second axes, respectively, at a speed which changes stochastically, whereby rotation of said mixing container about said axes affords a constantly irregular mixing movement and a constantly changing Froude number.

12. A device according to claim 11, wherein another of said first and second rotating means includes means for rotating the mixing container about another of said first and second axes, respectively, at a speed which changes stochastically.

13. A device according to claim 11, wherein one of said first and second rotating means includes means for changing the direction of rotation of the mixing container stochastically.

14. A device according to claim 11, including means mounting said mixing container for rotation about a third axis, third means for rotating said mixing container about said third axis, said third means including means for rotating the mixing container at a speed which changes stochastically.

15. A device according to claim 14 wherein said first, second and third axes of rotation are angularly related and nonparallel to one another.

* * * * *